US006427735B1

(12) United States Patent
Brazell et al.

(10) Patent No.: US 6,427,735 B1
(45) Date of Patent: Aug. 6, 2002

(54) MULTI-SPEED SURFACE PLANER AND METHOD OF MANUFACTURE THEREOF

(75) Inventors: Kenneth M. Brazell, Piedmont; Jeffrey M. Dils, Simpsonville, both of SC (US); Akio Takamura, Fuchu (JP)

(73) Assignee: One World Technologies, Inc., Anderson, SC (US)

( * ) Notice: Subject to any disclaimer, the term of this patent is extended or adjusted under 35 U.S.C. 154(b) by 0 days.

(21) Appl. No.: 09/793,178

(22) Filed: Feb. 26, 2001

(51) Int. Cl.[7] ..... B27M 1/00

(52) U.S. Cl. ..... 144/329; 74/473.1; 74/473.3; 74/483 PB; 29/30; 144/114.1; 144/117.1

(58) Field of Search ..... 74/473.1, 473.23, 74/473.3, 483 PB; 29/893.1, 30; 144/114.1, 117.1, 129, 130, 329; 451/499

(56) References Cited

U.S. PATENT DOCUMENTS

| | | | | |
|---|---|---|---|---|
| 3,718,168 A | | 2/1973 | Berends | |
| 4,431,073 A | | 2/1984 | Nagao et al. | |
| 4,436,126 A | | 3/1984 | Lawson | |
| 4,440,204 A | | 4/1984 | Bartlett | |
| 4,456,042 A | * | 6/1984 | Clark et al. | 144/129 |
| 4,485,859 A | * | 12/1984 | Krogstad | 144/114.1 |
| 4,561,325 A | | 12/1985 | Jester | |
| 4,710,071 A | | 12/1987 | Koehler et al. | |
| 4,729,260 A | | 3/1988 | Dudden | |
| 4,862,770 A | | 9/1989 | Smith | |
| 4,886,099 A | | 12/1989 | Ferreira de Abreu | |
| 5,090,268 A | | 2/1992 | Peeters | |
| 5,284,192 A | | 2/1994 | Sato et al. | |
| 5,588,930 A | | 12/1996 | Chen | |
| 5,809,836 A | | 9/1998 | Patzold et al. | |
| 5,829,498 A | | 11/1998 | Liao | |
| 5,842,913 A | | 12/1998 | Nemazi | |
| 5,927,357 A | | 7/1999 | Welsh et al. | |
| 5,957,173 A | | 9/1999 | Garcia | |
| 6,089,287 A | | 7/2000 | Welsh et al. | |

* cited by examiner

*Primary Examiner*—W. Donald Bray
(74) *Attorney, Agent, or Firm*—Brooks & Kushman P.C.

(57) ABSTRACT

A surface planer for planing wooden boards is provided having a motor and an associated rotary cutter head operatively driven thereby in a feed roller positioned adjacent the rotary cutter head for moving wooden boards to the plane relative to the cutter. A multi-stage chain transmission is interposed between the motor and the feed roller; the multi-stage transmission including a dual speed stage is provided with an operator actuated speed selector element which enables the operator to vary the final drive ratio and the resulting speed of the feed roller between a high and low speed.

20 Claims, 2 Drawing Sheets

MULTI-SPEED SURFACE PLANER AND METHOD OF MANUFACTURE THEREOF

TECHNICAL FIELD

The present invention relates to surface planers having variable speed feed rollers and methods of manufacture thereof.

BACKGROUND ART

Surface planers are most commonly provided with a pair of feed rollers; one on the in feed and one on the out feed side of the rotary cutter head for moving a wooden board to be planed relative to the cutter head at a fixed speed. The only adjustment an operator typically has for taking a light or heavy cut is the position the cutter head is spaced from the support platen which determines the depth of cut. When it is desired to take a light cut, a very small incremental adjustment is made between the in planing passes. When it is desired to make a rough cut, a relatively large in depth adjustment is made between planing passes so that the material is removed more quickly.

There have been limited efforts in the past to infinitely vary the speed of the board to be planed relative to the cutter head. U.S. Pat. No. 3,718,168 assigned to Rockwell Manufacturing Company, discloses a belt drive feed roller where the drive ratio can be varied by the operator using a variable diameter pulley system. U.S. Pat. No. 4,440,204 assigned to Shopsmith, Inc., discloses a planer attachment for a multipurpose tool which is provided with a separate variable speed drive motor for advancing the feed rollers. The speed of the feed rollers can be varied by the operator dependent upon the characteristics of the board to be planed.

The variable feed speed planers prior art tend to be bulky and expensive. The object of the present invention is to make a simple robust low cost multi-speed in feed roller drive system which can be adapted to the existing single speed planers with minimal modification.

DISCLOSURE OF INVENTION

Accordingly, a surface planer of the present invention is provided with a motor having an output member, a rotary cutting head operatively connected to the motor output member and at least one feed roller positioned parallel to and adjacent the rotary cutter head for moving a wood board to be planed relative to the rotary cutting head. A multi-stage transmission is interposed between the motor and the feed roller. The multi-stage transmission has an input connected to the motor and an output drivingly connected to a feed roller. The multi-stage transmission has a dual speed stage provided with an operator's actuated speed selector element which when shift between two positions, changes the final drive ratio resulting in a change in speed of the feed rollers.

In the preferred surface planer illustrated, the dual speed stage is provided by a planetary gear set which is the final stage and is remotely located from the remaining stages of the multi-stage transmission.

Also disclosed is a method of manufacturing a family of surface planers with differing in feed operating characteristics while maintaining part commonality. A basic surface planer subassembly is provided in a motor rotary cutter, a pair of feed rollers, frame including a platen, and a first gearbox having a multi-stage gear reduction including an input connected to the motor output member and a first gearbox output member. Wherein a low price single speed surface planer is fabricated by installing a fixed diameter circular drive element on the first gear box output member which is operatively coupled to the corresponding fixed diameter circular drive element on the feed roller by a flexible tensile member and trained thereabout. Alternatively a higher priced dual in feed speed surface planer can be fabricated by installing a second gearbox on the first gearbox output shaft, the second gearbox having a circular drive element forming a second gearbox output member operatively coupled to the fixed drive element on the feed roller by a flexible tensile member. The second gearbox is further provided with a speed selector element shiftable between a high and low position for selectively changing the gearbox drive ratio and the resulting rotational speed of the feed roller in order to enable the operator to vary the speed that a wooden board is fed post the rotary cutter head.

BEST MODE FOR CARRYING OUT THE INVENTION

Figure 1:
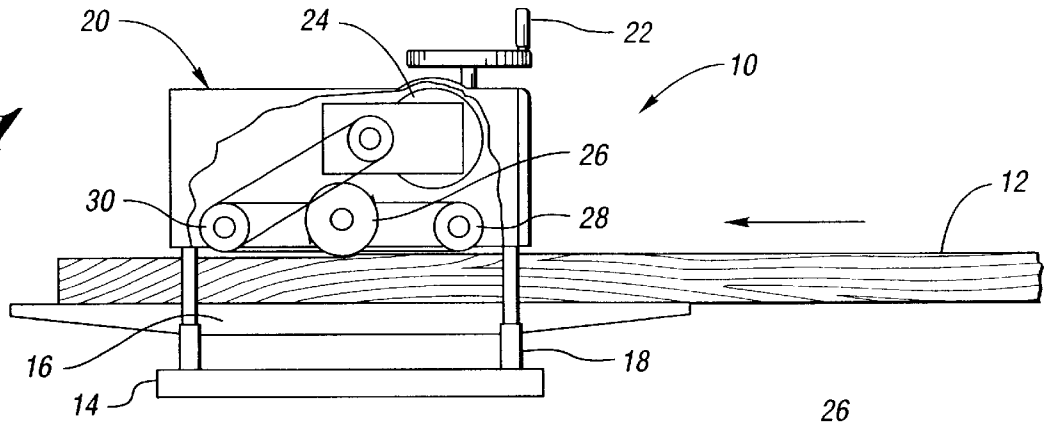
FIG. 1 is a perspective view of a Surface Planer of the present invention.

The surface planer 10 of the present invention is schematically shown in horizontal side elevation planing in elongate wood board 12. The surface planer, 10 illustrated, is a portable bench top type device, however, the present invention, is equally useful in a large stationary floor mounted tool. Surface planer 10 is made up of a frame 14 which includes a platen 16 for supporting the board that it is positioned thereupon and a series of columns 18 which extend vertically relative to the platen. In the surface planer embodiment 10 illustrated, the platen is fixed to frame and a motor cutter head assembly 20 is vertically positionable relative to the platen 16 by the operator upon rotation of handwheel 22 which is associated with a conventional screw drive height adjustment mechanism common in the art. Alternatively, the motor cutter head assembly 20 can be fixed relative to the frame and handwheel 22 can raise and lower the platen as is also well known in the surface planer art. Motor cutter head assembly 20 is made up of a motor 24, a rotary cutter head 26, a pair of feed roller 28 and 30, respectively disposed on the infeed and outfeed side of the cutter head, and a first gearbox 32 which forms a multi-stage transmission having a reduced speed first gearbox output member 34. The first gearbox output member 34 is operatively connected to at least one of the feed rollers 28 and 30. Similarly, motor 24 is operatively connected in driving relationship to cutter head 26. When the motor is turned on and running at its operating speed, the feed rollers are rotating in a first direction, causing the wood to move into and through the planer while the cutter head will be rotates in an opposite direction as illustrated in FIG. 1, so that the blades on the cutter head 26 cuts against the direction of the incoming wood board 12.

Figure 2:
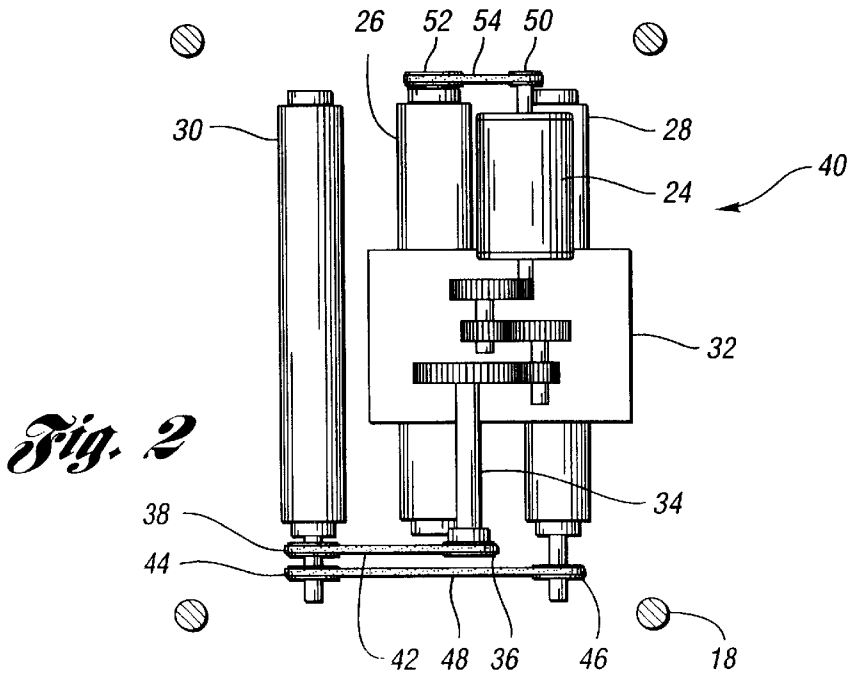
FIG. 2 is a top plan schematic view of a single speed Surface Planer.
Figure 3:
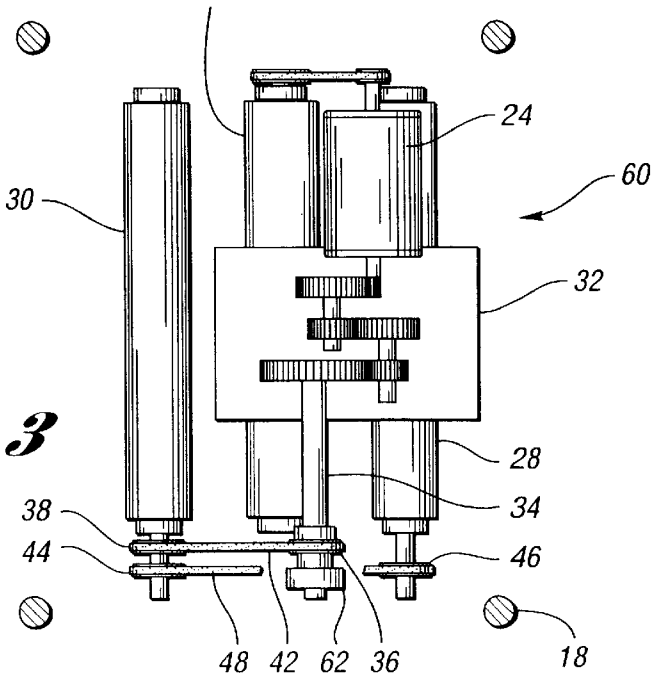
FIG. 3 is a top plan schematic view of a dual speed Surface Planer.

The surface planer of the present invention is specifically adapted to be fabricated as part of a family of high and low priced tools having maximum component part commonality. A relatively low priced single feed speed surface planer 40 is illustrated in FIG. 2, while the relatively higher priced dual speed surface planer 60 is illustrated in FIG. 3. The only difference between one speed surface planer 40 and dual speed surface planer 60 is the connection between the first gearbox output member 34 and out feed roller 30.

Single speed surface planer 40 illustrated in FIG. 2, has a fixed diameter circular drive element, namely a sprocket 36, affixed to the distal end of first gearbox output member 34. Sprocket 36 is operatively connected to corresponding sprocket 38 on outfeed drive roller 30 which are operatively connected together by a flexible tensile member, chain 42 which extends thereabout. Of course, rather than using sprockets and chains, belts and pulleys could be utilized. In the two embodiments illustrated, outfeed drive roller and infeed drive roller 30 and 28 are interconnected so that they rotate in unison in the same direction. Out feed drive roller 30 is provided with a sprocket 44 and in feed drive roller 28 is provided with a sprocket 46 which are interconnected by a chain 48 which cause the rollers to rotate in unison at an identical speed. Once again, belts and pulleys can be substituted for sprockets and chains. Belts and pulleys can be of the smooth or cog variety. Similarly, a pair of circular drive elements and a flexible tensile member interconnect motor 24 and cutter head 26. In the embodiment illustrated, this connection is achieved by sprocket 50 on the motor output shaft, sprocket 52 on the cutter head and chain 54 extending thereabout.

In the preferred embodiment, illustrated motor 24 is the dual output shaft variety having an output shaft extending from both axial ends of the motor; one end is associated with the cutter head and the opposite end is associated with the first gearbox 32. Cutter head 26 and infeed and out feed rollers 28 and 30 are mounted relative to the frame portion of motor cutter head assembly 20 by a series of conventional roller bearings illustrated.

Figure 5:
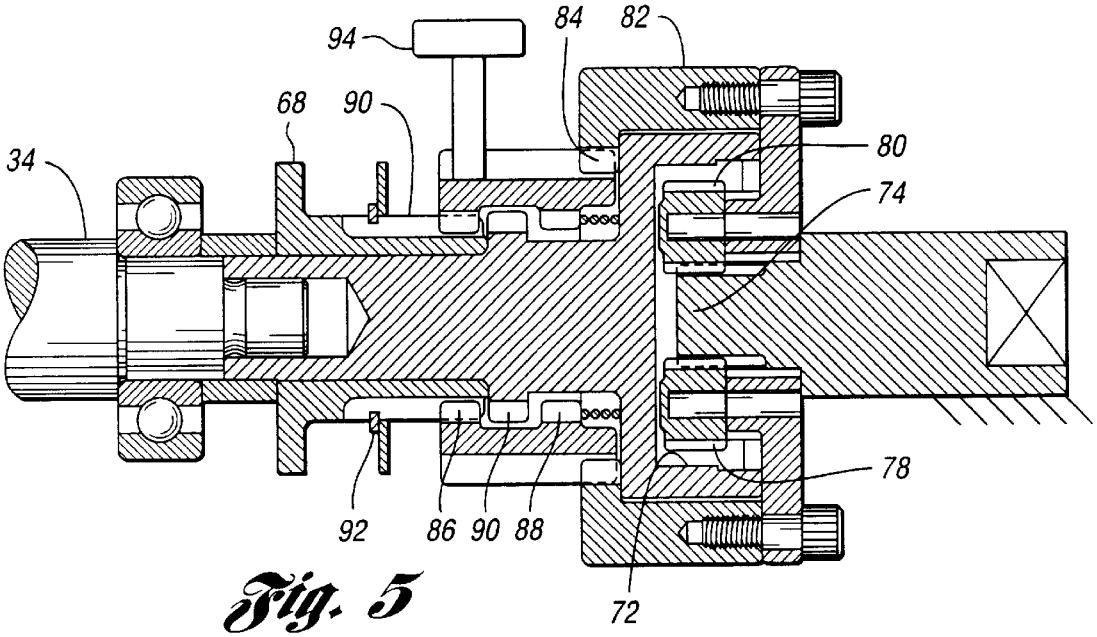
FIG. 5 is a crossectional view of the gear box in the low speed mode.
Figure 6:
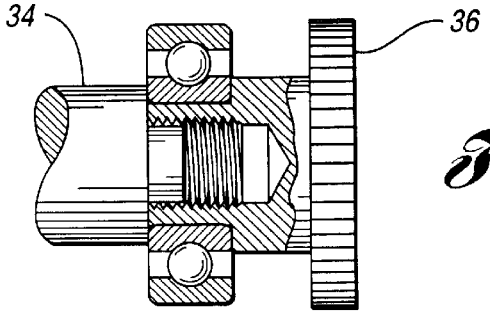
FIG. 6 is a crossection of the sprocket member used in the single speed mode.

Two speed surface planer 60 illustrated in FIG. 3, differs from the one speed surface planer 40 illustrated in FIG. 2 in one area. Rather than having a sprocket 36 on a the distal end of first gearbox output member 34, a second gearbox 62 is affixed to the shaft, as illustrated in FIG. 3. An enlarged cross-sectional view of second gearbox 62 is provided in FIGS. 4 and 5. A corresponding in enlarged cross-sectional view of sprocket 36 mounted on the distal end of first gearbox output member 34 as illustrated in FIG. 6. Second gearbox 62 is provided with an input member 64 which is affixed to and rotates with first gearbox output member 34, and output member 66 which includes a sprocket 68 and a speed selector element 70 which is shiftable between a high speed position illustrated in FIG. 4 and a low speed position illustrated in FIG. 5.

The preferred embodiment of the second gearbox illustrated utilizes a planetary gear set to change the final drive ratio between input member 64 and output member 66. When speed selector element 70 is in the high speed position illustrated in FIG. 4, the output member and input member 66 and 64 rotate in unison. When speed selector element 70 is moved to the low speed position as shown in FIG. 5, output member 66 rotates at approximately half the speed of input member 64. Speed reduction is achieved by a planetary gear set made up of a ring gear 72 which is affixed to the output member 66, sun gear 74 is fixed relative to frame 14, and a planet carrier 76 and associated planet gears 78 and 80. A collar member 82 is affixed to and rotates with planet carrier 76. Collar 82 is provided with an internally splined bore 84 which is sized to engage the splined exterior surface 86 about the periphery of speed selector element 70. The internal bore of speed selector element 70 is provided with two spaced apart internally splined regions 86 and 88. Splined region 86 slidingly engages the splined outer periphery of output member 66 to cause the output member 66 and the speed selector element 70 to always rotate in unison. Spline region 88 on the interior of speed selector element 70 alternatively engages or disengages splined outer peripheral segment 90 with input member 64.

Figure 4:
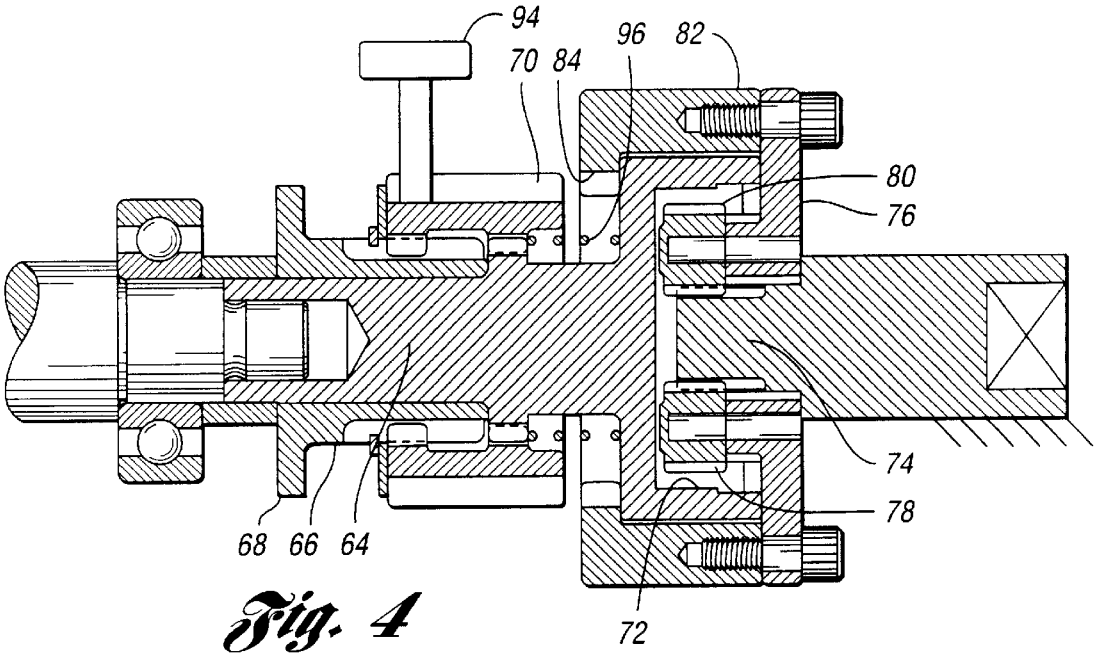
FIG. 4 is a crossectional view of the gear box in the high speed mode.

Referring to FIG. 4, when the speed selector element 70 is shifted to the left as illustrated, into abutment with snap ring 92 i.e. high speed position, spline region 88 on speed selector element 70 engages spline 90 on the output member 66 to cause the input member 64, the speed selector element 70 and the output member 66 to rotate together in unison. When speed selector element 70 in the high speed position abuts snap ring 92, the splined region 86 on the outer periphery thereof is disengaged from spline bore 84 in collar 82. This enables the planet carrier 76 and planet gear 78 to rotate freely when the planer is being operated in the high speed mode.

When speed selector element 70 is shifted toward the planet carrier 76 to the low speed mode as illustrated in FIG. 5, spline region 88 on the interior of the speed selector element 70 is disengaged from spline segment 90 on the outer periphery of the output member, enabling the input member 64 and output member 66 to rotate relative to one another. Simultaneously, spline region 86 and the outer periphery of the speed selector element 70 engages splined bore 84 on collar 82, causing planet carrier 76, the speed selector element 70 and the output member 66 to rotate in unison. In the low speed mode illustrated in FIG. 5, as input member 64 rotates, ring gear 72 which is affixed to input member 64 rotating causing the planet gears 78 and 80 to rotate and orbit about sun gear 74. As planet gears 88 and 90 orbit about the sun gear 74, planet carrier 76 is caused to rotate at a speed which is substantially reduced from the speed of the input member 66. The precise speed of the rotation is dictated by the relative diameter of the sun, ring and planet gears, however, in the present example, the speed reduction of a little less than 50% is achieved in the low speed mode relative to the high speed mode. In order enable the operator to shift the speed selector element, a simple knob and fork mechanism 94 is provided. A knob and a fork 94 move axially with speed selector element 70, and, the speed selector is able to freely rotate relative to the fork in a conventional manner.

Preferably, a coil spring 96 will be provided to bias the speed selector element 70 to one of the two speed states. In the embodiment illustrated, spring 96 biases speed selector element 70 to the high speed position shown in FIG. 4. A conventional detent not shown, will be provided on the knob and fork assembly 94 to retain speed selector element 70 in the low speed mode, when the knob is shifted to the low speed position by the operator.

The planetary gear arrangement enables the second gearbox 62 to made quite compact and readily interchangeable with sprocket 36 without varying the location of sprocket 36 with that of a sprocket 68 on the second gearbox. Alternatively, the two speed gearbox could be fabricated with an intermediate shaft and two more sets of different ratio gear pairs, however, the planetary gear mechanism is preferred due to its compact size and mounting interchangeability.

In the embodiment illustrated, second gearbox 62 is remotely located and distinct from the first gearbox 32.

Alternatively, it would be possible to locate the two speed gear set found in the second gearbox within or immediately adjacent to the first gearbox, with preferably the two speed gearbox making up the final stage of the multi-stage gear reduction transmission. In the embodiment illustrated, the first gearbox 32 has three gear reduction stages accomplished by three pairs of gears oriented on two intermediate shafts, the input shaft of the motor and the first gearbox output member as illustrated in FIGS. 2 and 3. While a three stage gear reduction is used in the preferred embodiment, a two or a four stage gear reduction in the first gearbox can alternatively be used.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A surface planer for planing a wood board, comprising:

a motor having a rotationally driven motor output member turning at a first rotational speed;

a rotary cutter head operatively connected to and rotationally driven by the motor output member;

a first gearbox having a first gearbox input member connected to the motor output member and a first gearbox output member which has a second rotational speed which is less than the first rotational speed;

a second gearbox having a second gearbox input member connected to the first gearbox output member, a second gearbox output member, and a speed selector element shiftable between a high and low speed position for selectively changing the rotational speed of the second gearbox output member; and a feed roller for moving a wooden board to be planed toward the cutter, the feed roller operatively connected to the second gearbox output member wherein the speed that the wooden board is fed into the cutter is dictated by the position of the speed selector element selected by the operator.

2. The surface planer of claim 1 wherein the second gearbox further comprises a two speed planetary gear set.

3. The surface planer of claim 1 wherein the first gearbox further comprises an intermediate shaft transmission having at least two stages.

4. The surface planer of claim 3 wherein the intermediate shaft transmission is provided with at least two intermediate shafts and at least three stages.

5. The surface planer of claim 3 wherein the first gearbox output member extends outwardly therefrom parallel to and spaced from the feed roller.

6. The surface planer of claim 5 wherein the first gearbox output member is provided with a distal end to which the second gearbox is connected.

7. The surface planer of claim 6 wherein the feed roller is operatively connected to the second gearbox output member by a flexible tensile member and trained about a pair of circular drive elements respectively associated with the second gearbox output member and the feed roller.

8. The surface planer of claim 7 wherein the flexible tensile member comprises a chain and the circular drive elements comprise sprockets.

9. The surface planer of claim 6 having dual feed rollers which rotate in unison on the in feed and out feed sides of the cutter head.

10. A surface planer for planing a wooden board comprising:

a motor having a rotationally driven motor output member turning at a first rotational speed;

a rotary cutter head operatively connected to and rotationally driven by the motor output member;

a pair of feed rollers longitudinally spaced about the rotary cutter head;

a frame including at least two laterally spaced apart columns on opposite lateral sides of the board to be planed and a platen which is adjustably positionable by the operator at a selected distance from the cutter head in order to achieve a selected board thickness; and a multi-stage transmission having an input connected to the motor and an output drivably connected to at least one of the feed rollers, the multi-stage transmission including a dual speed stage provided with an operator actuated speed selected element which when shifted by the operator, changes the file drive ratio and the resulting speed that the feed rollers move the wood relative to the cutter head.

11. The surface planer of claim 10 wherein the dual speed stage comprises a planetary gear set.

12. The surface planer of claim 10 wherein the dual speed stage is the final stage of the multi-stage transmission.

13. The surface planer of claim 12 wherein the dual speed stage is a planetary gear set.

14. The surface planer of claim 10 wherein the feed rollers are operatively connected to one another to rotate in unison.

15. The surface planer of claim 14 wherein the feed rollers operatively connect to one another and to the final stage of the multi-stage transmission by a pair of chains and two associated pairs of sprockets.

16. The surface planer of claim 10 wherein the multi-stage transmission further comprises a first multi-stage fixed speed gearbox and a second two speed gearbox removably connected to and spaced from the first multi-stage fixed speed gearbox.

17. The surface planer of claim 16 wherein the two speed gearbox further comprises a planetary gear set.

18. A method of manufacturing a family of surface planers with differing feed characteristics while maximizing component part commonality, the method comprising;

fabricating a basic surface planer subassembly having a motor for imparting a rotationally driven motor output member turning at a first rotational speed, a rotary cutter head operatively connected to and rotationally driven by the motor output member, a pair of feed rollers longitudinally spaced about the rotary cutter head, a frame including at least two laterally spaced apart columns on opposite lateral sides of the board to be planed and a platen which is adjustably positionable by the operator at a selected distance from the cutter head in order to achieve a selected board thickness;

forming a low price single speed in feed surface planer by installing a fixed diameter circular drive element on the first gearbox output member which is operatively coupled to a fixed diameter circular drive element installed on one of the feed rollers by a flexible tensile member and trained thereabout; and forming a high priced dual speed in feed surface planer by installing a second dual speed gearbox having a second gearbox input member connected to the first gearbox output member, a circular drive element forming a second gearbox output and a feed selector element shiftable between a high and low position for selectively changing the drive ratio and the resulting rotational speed of the feed rollers.

19. The method of claim 18 wherein the second gearbox used to form the higher priced dual speed in feed surface planer is provided with a two-speed planetary gear set.

20. The method of claim 18 wherein the first gearbox output member is provided with an elongate shaft with a distal end adapted to alternatively accept either of the fixed diameter circular drive element and the two-speed gearbox without otherwise altering the feed roller and drive system.

* * * * *